US006317573B1

(12) United States Patent
Baker et al.

(10) Patent No.: US 6,317,573 B1
(45) Date of Patent: Nov. 13, 2001

(54) APPARATUS AND METHODS FOR PRINT CARTRIDGE PROTECTION

(75) Inventors: Douglas M. Baker, Avon; Richard J. Orico, Webster, both of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/570,930

(22) Filed: May 15, 2000

(51) Int. Cl.[7] ..... G03G 21/18; G03G 21/16
(52) U.S. Cl. ..... 399/114; 399/111
(58) Field of Search ..... 399/109, 102, 399/111, 114, 116

(56) References Cited

U.S. PATENT DOCUMENTS 4,655,578 * 4/1987 Kurtz et al. ..... 399/114
5,307,117 * 4/1994 Harlan ..... 399/114
5,708,924 * 1/1998 Shogren et al. ..... 399/116
5,918,091 * 6/1999 Saeki ..... 399/116 X
5,974,287 * 10/1999 Kurz et al. ..... 399/114
6,014,535 * 1/2000 Zenk et al. ..... 399/116
6,097,912 * 8/2000 Watson et al. ..... 399/116

* cited by examiner

*Primary Examiner*—Sandra Brase
(74) *Attorney, Agent, or Firm*—Oliff & Berridge, PLC

(57) ABSTRACT

Apparatus and method for protecting a print cartridge that eliminates an adhesive strip. The print cartridge protector uses a hook shaped end inserted into a slot defined by the print cartridge to keep the print cartridge protector in engagement with the print cartridge. The opposite end may be held in place by another hook shaped end or a loop inserted in another end of the print cartridge.

21 Claims, 4 Drawing Sheets

APPARATUS AND METHODS FOR PRINT CARTRIDGE PROTECTION

BACKGROUND OF THE INVENTION

1. Field of Invention

This invention relates to abrasion resistive packaging, such as packaging to protect a photoreceptor of a print device.

2. Description of Related Art

In current printing applications, print cartridges are incorporated in printing devices. The print cartridges contain a printing material, such as toner. Typically, the print cartridges are replaceable, and the print cartridges are discarded when they run out of toner, and a new print cartridge is inserted into the print device. The disposability of the print cartridges requires that new print cartridges be shipped.

SUMMARY OF THE INVENTION

Portions of the print cartridge can be damaged during shipping or storage prior to use. For example, the photoreceptor is sensitive to abrasion. Thus, it is desirable to protect the print cartridge so as to protect the photoreceptor from damage.

In printing applications, photoreceptor drums are used to transfer toner from a storage area to a recording medium. These photoreceptor drums are sensitive to abrasion which may wear off the photoreceptor coating. One method of protecting these print cartridges is to use heavy paper during storage and transport to prevent damage to the photoreceptor drum.

A photoreceptor protector covers the photoreceptor drum which is contained in a print cartridge. The print cartridge is used in various models of printers, copiers, facsimile machines to produce output on the recording medium. Print cartridges need replacement on a regular basis as the print cartridges hold toner and the toner is used to make recordings on a recording material. The toner thereby runs out and either needs to be replenished or the print cartridge needs to be replaced.

One example of photoreceptor protectors utilize heavy paper with at least one adhesive zone to attach the heavy paper to the print cartridge. The photoreceptor protector is then removed by peeling the heavy paper and adhesive off of the print cartridge to expose the photoreceptor drum.

The adhesive used to attached the photoreceptor protector to the print cartridge can be problematic. The adhesive can be difficult to apply. Errors in applying the adhesive include the adhesive being applied to the wrong area or in an excessive amount. Further, once applied, the adhesive will not always be completely removed from the print cartridge when the photoreceptor protector is removed.

This invention provides systems and methods for protecting the photoreceptor drum without using adhesive. The adhesives are eliminated by the use of a hook type fold feature. The hook type fold feature holds the end of the photoreceptor protector in place without the use of adhesives. Thus the systems and methods of this invention reduce the number and amount of adhesives needed during manufacture. Further, the systems and methods of this invention make for a simpler photoreceptor protector that is more environmentally friendly because of the lack of adhesives.

The systems and methods according to this invention take advantage of the discovery that print cartridges have areas capable of receiving a portion of a folded photoreceptor protector that will retain the portion of the photoreceptor protector without the need for adhesive.

Lastly, the systems and methods of this invention allow for easier removal of the photoreceptor protector from the print cartridge because the person removing the photoreceptor protector does not have to remove the adhesive.

These and other features and advantages of this invention are described in or apparent from the following detailed description of the preferred embodiments.

BRIEF DESCRIPTION OF THE DRAWINGS

The invention will be described with reference to the accompanying drawings, in which like elements are labeled with like numbers and in which.

DETAILED DESCRIPTION OF PREFERRED EMBODIMENTS

Figure 1:
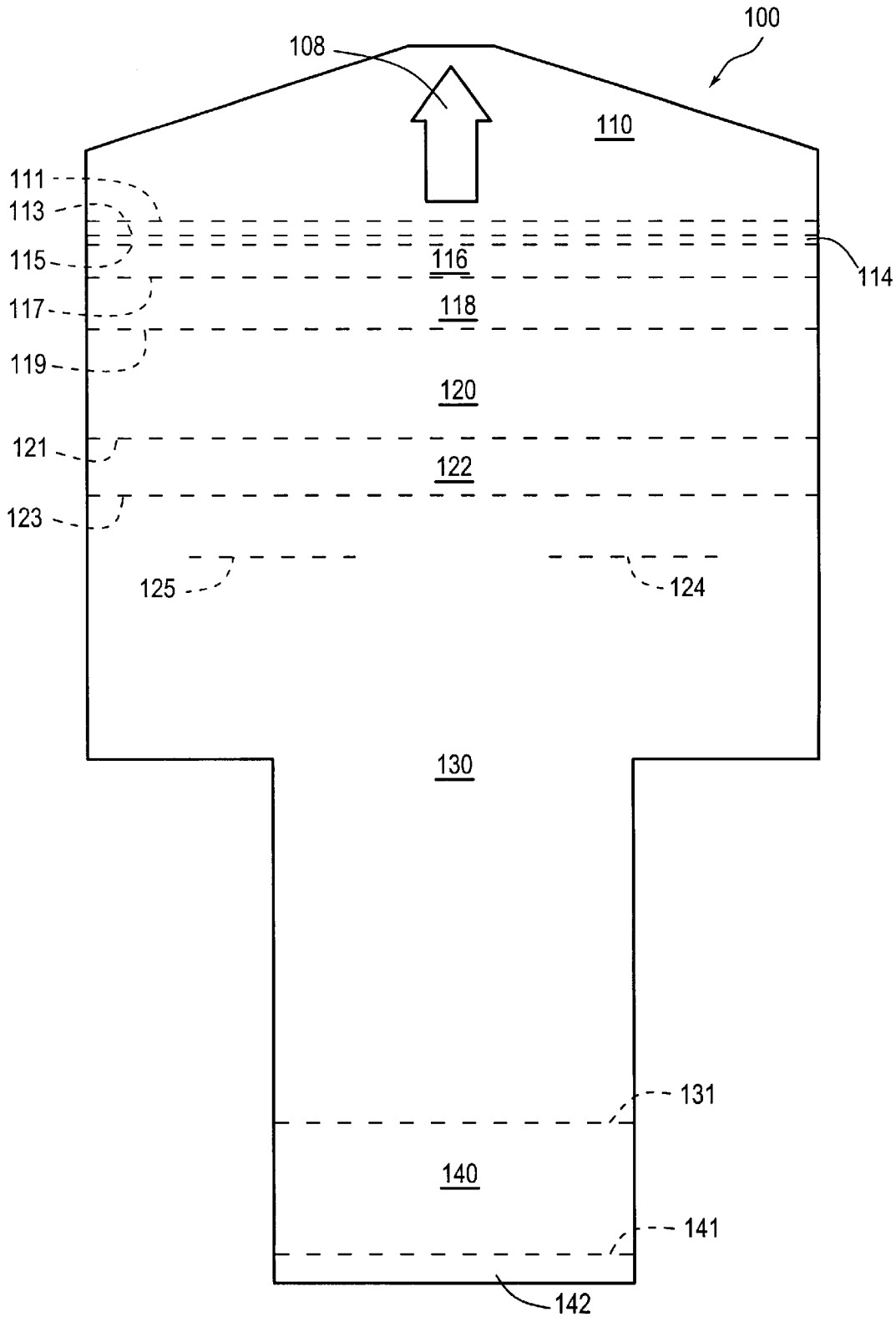
FIG. 1 shows an exemplary embodiment of the photoreceptor protector in a stage of construction according to this invention.

FIG. 1 shows an exemplary photoreceptor protector 100 according to this invention after the source material has been cut and scored. The exemplary photoreceptor protector 100 is first formed with a pull tab 110. The pull tab 110 has pull arrow 108 printed on it. Photoreceptor protector 100 is the n formed with fold lines 111, 117, 119, 121, 123, 131 and 141. Adhesive is applied to tape adhesive region 114 and scorings are placed at scoring marks 124 and 125.

Photoreceptor protector 100 is, for example, bent along lines 121 and 119 to form the top insert region 120, bent along line 117 to form the top holding region 118 and bent along line 123 to form the top holding region 122. The tape adhesive region 114, between dashed lined 113 and 115 has adhesive applied before being attached to the photoreceptor cover region 130. Thus, the top insert region 120 may be made by using an adhesive strip in the top adhesive region 114 to attach the photoreceptor protector back to itself. Photoreceptor protector 100 may be bent along line 131 to form the bottom insert region 140 and bent along line 141 to form the bottom holding region 142.

Photoreceptor protector 100 as shown in the exemplary embodiment is made of paper. However, other embodiments such as plastic, plastic impregnated paper, foam, cardboard or any other material now known or later developed that can be used for the photoreceptor protector 100. For example, the photoreceptor protector 100 can be constructed at least partially of foam, which will also protect against impacts.

Further, in the exemplary embodiment the photoreceptor protector 100 is flexible, to protect against abrasion only. However, various exemplary embodiments can also be rigid in portions such that the print cartridge is protected against moisture and/or impact damage.

Photoreceptor cover region 130 is shown with a notched configuration such that bottom insert region 140 is smaller in width than top insert region 120. This is done to show an exemplary preferred embodiment. Bottom insert region 140 may be the same width as top insert region 120 or wider than top insert region 120 in other various exemplary embodiments.

The top adhesive region 114 uses adhesive in the preferred exemplary embodiment. However, other fastening materials and methods such as staples, clips and melting may be used in other exemplary embodiments.

Further, scoring marks 124 and 125 in the preferred embodiment are for the convenience ensuring that photoreceptor cover region 130 is as straight as possible and may be eliminated or moved in other various exemplary embodiments.

Even further, bend lines 111, 117, 119, 121 and 123 and top spacer region 116 may be long or short to space pull tab 110 at any space for the operator to pull tab 110 and disengage the photoreceptor cover 100.

Pull arrow 108 is shown in the preferred embodiment for the convenience of the user. Pull arrow 108 may be moved, changed or eliminated in various exemplary embodiments.

Bottom holding region 142 and pull tab 110 are shown with tapered ending zones as a preferred embodiment. Bottom holding region 142 and pull tab 110 may be square or more radically tapered in other various exemplary embodiments.

Figure 2:
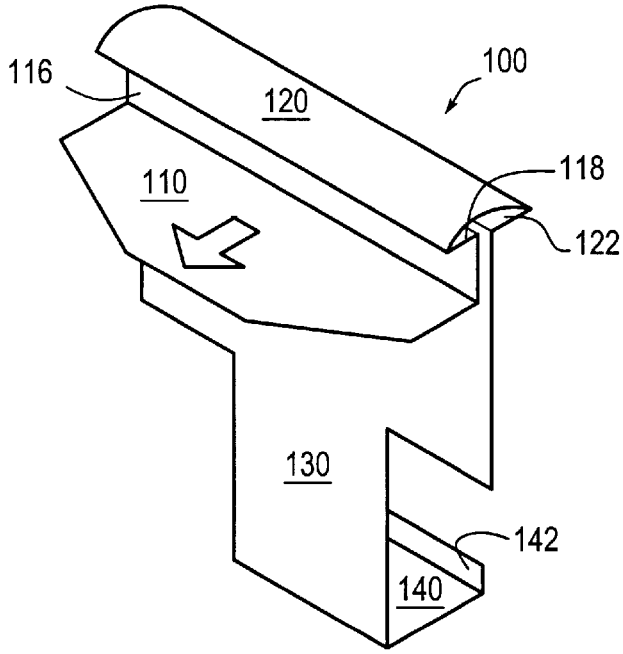
FIG. 2 is another exemplary embodiment of the photoreceptor protector as fully assembled and prepared for installation on a print cartridge.

FIG. 2 shows an example of a photoreceptor protector 100 folded into its final shape. Pull tab 110 is bent away from the photoreceptor cover region 130 and top insert region 120 is formed by the folding back top holding regions 118 and 122. Bottom holding region 140 and 142 are fold formed by folding along lines 131 and 141 to form the preferred hook shape.

The top region 120 is, for example, inserted in the top end of the print cartridge with the pull tab 110 facing away from the print cartridge. Photoreceptor cover region 130 then lays along the outer surface of the print cartridge 10 covering the photoreceptor 20. Bottom insert region 140 is inserted in an opposite end of the print cartridge where bottom holding region 142 is bent up to hold bottom insert region 140 along the bottom side of the print cartridge thereby holding the photoreceptor cover region 130 in a position to protect the photoreceptor 20.

Figure 3:
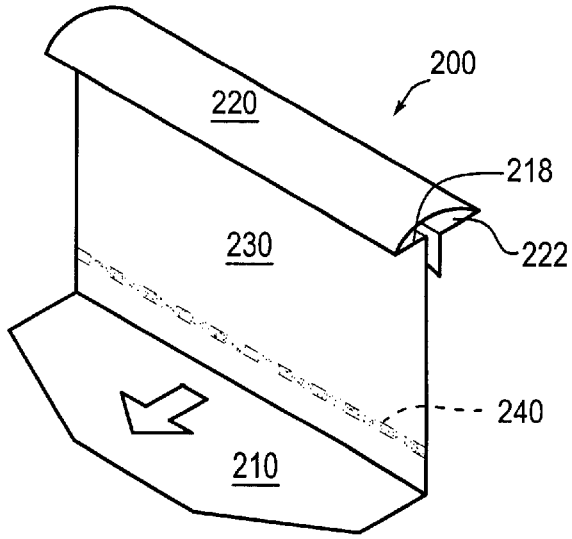
Fig. 3 Related Art
FIG. 3 is a related art diagram of a photoreceptor protector as it is prepared for installation on a print cartridge.

FIG. 3 shows a related art photoreceptor protector 200 that utilizes top insert region 220 held by top holding regions 222 and 218. The photoreceptor is covered by photoreceptor cover region 230 and held in place by adhesive strip 240. Pull tab 210 is then situated below the adhesive strip 240 for the user to remove the photoreceptor protector 200.

The photoreceptor protector 200 uses a pressure sensitive adhesive in the adhesive strip 240 to attach the cover 200 to the print cartridge 10. If operators are not careful with the placement of this adhesive strip on the cartridge, several problems may arise, resulting in the cover sticking either too well or not well enough. Also, if there are any oils or mold on the cartridge, the adhesives do not hold well on the cartridge 10. If the photoreceptor protector 200 comes loose, the adhesive strip 240 may cause catastrophic cartridge failure by adhering to the photoreceptor 20. The invent ion eliminates the adhesive strip 240. This is accomplished, for example, by lengthening the drum cover region 130 and adding bottom insert region 140 and bottom holding region 142 so that the end cover hooks into the cartridge 10 and is secured in place.

Both the claimed photoreceptor protector 100 and the related art photoreceptor protector 200 use a top insert region 120 and 220 on the photoreceptor protector which "expands" to fill a gap in the print cartridge.

The related art design is expensive due to the cost of the adhesive strip 240. The systems and methods of the invention improve on the related art photoreceptor protector 200 due to the elimination of the adhesive strip region 240. Elimination of this bottom adhesive region 240 creates multiple savings due to a shorter assembly line, fewer adhesives used and less materials cost.

Figure 4:
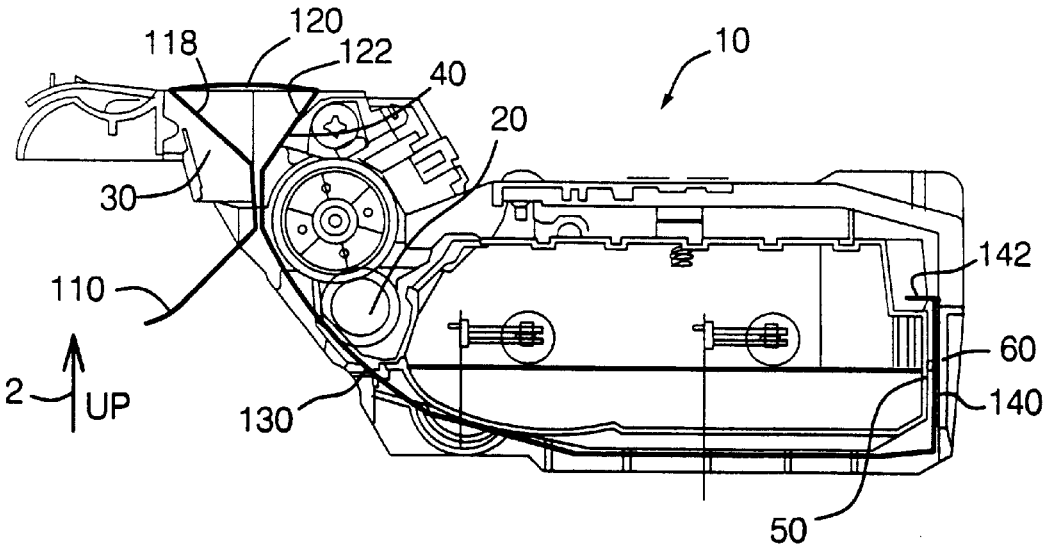
FIG. 4 is a functional block diagram of the print cartridge and photoreceptor protector with the photoreceptor protector installed.

FIG. 4 shows an exemplary embodiment of the photoreceptor protector 100 installed in an exemplary print cartridge 10. As shown in FIG. 4, arrow 2 indicates the up direction for the print cartridge 10.

The photoreceptor protector 100 covers the photoreceptor 20. The top insert region 120 has top holding region 118 resting against front cover 30 and top holding region 122 resting against print cartridge edge 40. The pull tab 110 juts out away from the print cartridge 10 such that a user may pull the pull tab 110 to remove the drum cover 100. The photoreceptor cover 130 extends down from the top insert region 120 to cover the photoreceptor 20 towards the bottom insert regions 140. Bottom insert region 140, for example, is inserted in between back cover 50 and holder 60 such that bottom insert region 140 is held in place by bottom holding region 142 that is bent.

Top insert region 120 has top holding regions 118 and 122 resting on print cartridge regions 30 and 40. However, top insert region 120 can fit into any opening in the top of a print cartridge such that top holder regions 118 and 122 serve to keep the photoreceptor protector 100 in place. Further, bottom insert region 140 is shown sandwiched between back cover 50 and holder 60. However, bottom insert region 140 can be inserted into any appropriate area at the bottom of the print cartridge 10 such that the bottom holding region 142 can be bent and hold bottom insert region 140 in place.

Figure 5:
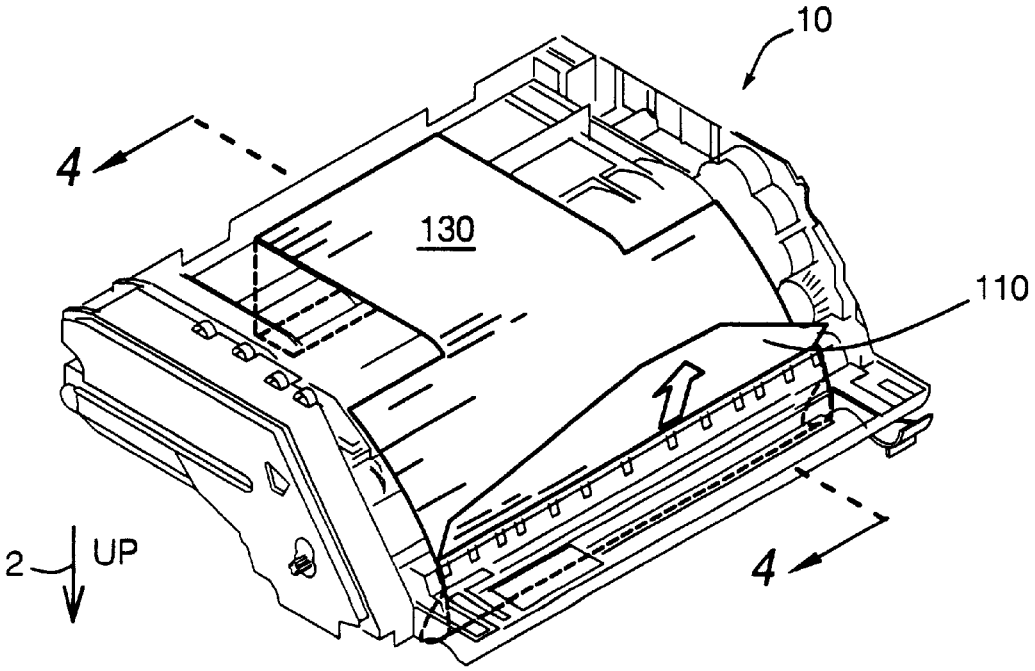
FIG. 5 is a functional block diagram of a perspective view of the photoreceptor protector installed on the print cartridge.

FIG. 5 shows an exemplary embodiment of the drum cover 100 on the print cartridge 10 from a perspective view. Arrow 2 indicates the up direction corresponding to the up direction shown in FIG. 4. Drum cover 100 has drum cover photoreceptor cover region 130 and pull tab 110 showing.

Figure 6:
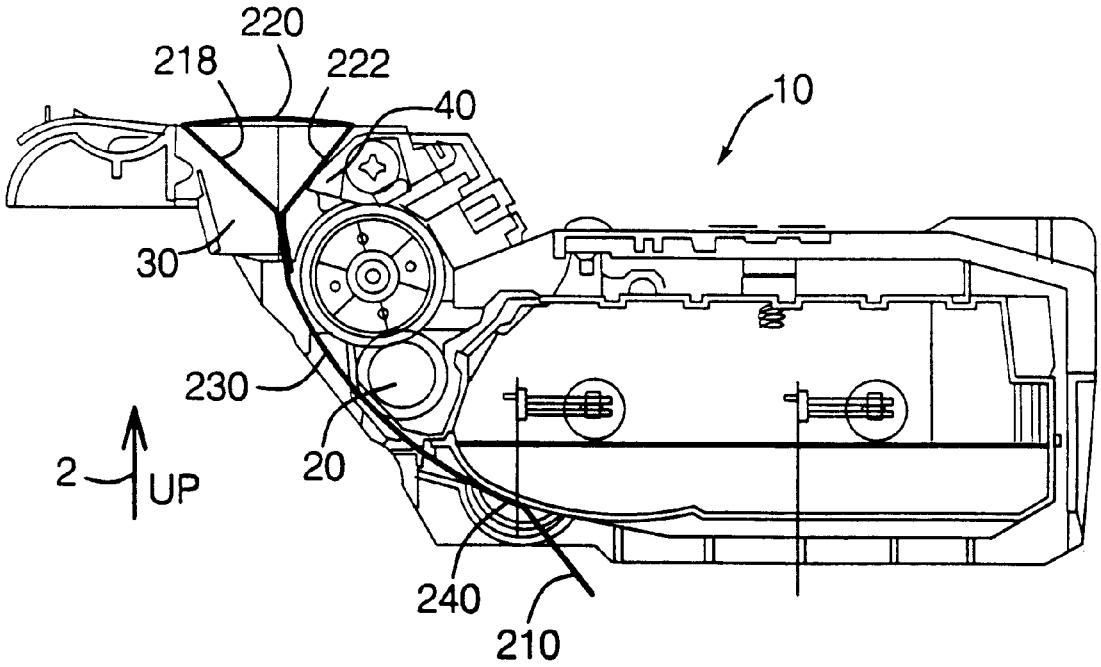
Fig. 6 Related Art
FIG. 6 is a functional block diagram of a related art photoreceptor protector installed in the print cartridge.

FIG. 6 shows an related art diagram of the photoreceptor protector 200 installed in the print cartridge 10. As shown in FIG. 6, arrow 2 indicates the up direction for the print cartridge 10.

The photoreceptor protector 200 covers the print cartridge 10 such that the photoreceptor 20 is protected. The top insert region 220 has top holding region 218 resting against front cover 30 and top holding region 222 resting against print cartridge edge 40. The pull tab 210 juts out away from the print cartridge 10 such that a user may pull the pull tab 210 to remove the drum cover 200 by peeling off the adhesive strip 240.

While this invention has been described in conjunction with specific embodiments outlined above, it is evident that many alternatives, modifications and variations will be apparent to those skilled in the art. Accordingly, the preferred embodiments of the invention, as set forth above, are intended to be illustrative, not limiting. Various changes may be made without departing from the spirit and scope of the invention.

What is claimed is:

1. A print cartridge protector usable to protect a photoreceptor of a print cartridge, the print cartridge including a first securing part, a second securing part positioned opposite the first securing part, and a third part, the print cartridge protector comprising:

a first securing region;

a second securing region; and a photoreceptor protecting region extending between the first securing region and the second securing region, wherein:

the first securing region is adapted to be located between the first securing part and the second securing part and is adapted to engage with at least one of the first and second securing parts; and the second securing region is adapted to extend a least partially around the third part, such that when the print cartridge protector is installed into the print cartridge, the print cartridge protector is secured to the print cartridge by the first and second securing regions and the photoreceptor protecting region is positioned adjacent to the photoreceptor.

2. The print cartridge protector of claim 1, wherein the first securing region comprises a first area and a second area, the first area adapted to at least partially rest against the first securing part and the second area adapted to at least partially rest against the second securing part.

3. The print cartridge protector of claim 2, wherein the first area is fixed to the second area.

4. The print cartridge protector of claim 3, wherein at least one of adhesive, staples, melting, and clips is used to fix the first and second area.

5. The print cartridge protector of claim 1, further comprising a pull tab region adjacent to the first securing region.

6. The print cartridge protector of claim 5, wherein the pull tab region is located on a side of the first securing region opposite the photoreceptor protecting region.

7. The print cartridge protector of claim 1, wherein the print cartridge protector is constructed of at least one of paper, plastic, foam, plastic impregnated paper, and cardboard.

8. The print cartridge protector of claim 1, wherein the first securing region has a width different than the second securing region.

9. A print cartridge including the print cartridge protector of claim 1.

10. A method of protecting a photoreceptor of a print cartridge, the print cartridge including a first securing part, a second securing part, and a third part, comprising:

inserting a print cartridge protector into the print cartridge, the print cartridge protector including a first securing region, a second securing region, and a photoreceptor protecting region;

locating the first securing region between the first securing part and the second securing part; and bending said second securing region to extend at least partially around at least the third part, such that, when the print cartridge protector is installed into the print cartridge, the print cartridge protector is secured to the print cartridge by the first and second securing regions and the photoreceptor protecting region is positioned adjacent to the photoreceptor.

11. The method of claim 10, wherein the first securing region includes a first area and a second area, the method further comprising fixing the first area to the second area.

12. The method of claim 11, wherein fixing the first area to the second area comprises fixing the first area to the second area using at least one of adhesive, staples, melting and slips.

13. The method of claim 10, further comprising removing the print cartridge protector from the print cartridge using a pull-tab, the pull-tab located adjacent the first securing region.

14. A print cartridge comprising:

a first securing part;

a second securing part opposite to the first securing part;

a third part;

a photoreceptor; and a print cartridge protector usable to protect the photoreceptor, the print cartridge protector having a first securing region, a second securing region, and a photoreceptor protecting region extending between the first and second securing regions;

wherein the first securing region is adapted to be located between the first securing part and the second securing part and adapted to engage with at least one of the first and second securing parts; and the second securing region is adapted to extend at least partially around the third part such that, when the print cartridge protector is installed into the print cartridge, the print cartridge protector is secured to the print cartridge by the first and second securing regions and the photoreceptor protecting region is positioned adjacent to the photoreceptor.

15. The print cartridge of claim 14, wherein the first securing region comprises a first area and a second area, the first area adapted to at least partially rest against the first securing part and the second area adapted to at least partially rest against the second securing part.

16. The print cartridge of claim 14, wherein the first area is fixed to the second area.

17. The print cartridge of claim 16, wherein at least one of adhesive, staples, melting, and clips is used to fix the first area and the second area.

18. The print cartridge of claim 14, wherein the print cartridge protector further comprises a pull-tab region adjacent to the first securing region.

19. The print cartridge of claim 18, wherein the pull tab region is located on a side of the first securing region opposite the photoreceptor protecting region.

20. The print cartridge of claim 14, wherein the print cartridge protector is constructed of at least one of paper, plastic, foam, plastic impregnated paper, and cardboard.

21. The print cartridge of claim 14, wherein the first securing region has a width different than the second securing region.

* * * * *